United States Patent [19]

Silliman et al.

[11] Patent Number: 4,916,436

[45] Date of Patent: Apr. 10, 1990

[54] OVERHEATED STOVE PIPE ALARM

[75] Inventors: Mike Silliman, Deansboro; Kevin Miles, Manlius; Edward Reynolds, Liverpool, all of N.Y.

[73] Assignee: Consumer Products International, Inc., Skaneateles, N.Y.

[21] Appl. No.: 275,960

[22] Filed: Nov. 25, 1988

[51] Int. Cl.[4] ..... G08B 17/06

[52] U.S. Cl. ..... 340/586; 340/594; 340/693

[58] Field of Search ..... 340/586, 594, 693

[56] References Cited

U.S. PATENT DOCUMENTS

| | | | |
|---|---|---|---|
| Re. 30,619 | 5/1981 | Decker | 219/506 |
| 2,907,992 | 10/1959 | Bronikowski | 340/594 |
| 2,982,949 | 5/1961 | Pivetz | 340/227 |
| 3,024,657 | 3/1962 | Brown | 340/584 |
| 3,745,545 | 7/1973 | Darbo | 340/586 |
| 4,255,746 | 3/1981 | Johnson et al. | 340/577 |
| 4,315,256 | 2/1982 | Dennis | 340/590 |
| 4,357,602 | 11/1982 | Lemelson | 340/539 |
| 4,364,032 | 12/1982 | Narato et al. | 340/679 |
| 4,636,776 | 1/1987 | Leaming | 340/594 |
| 4,712,095 | 12/1987 | Georgis, II | 340/584 |
| 4,800,371 | 1/1989 | Arsi | 340/586 |

*Primary Examiner*—Joseph A. Orsino
*Assistant Examiner*—Geoff L. Sutcliffe
*Attorney, Agent, or Firm*—Jacobs & Jacobs

[57] ABSTRACT

A warning apparatus alerts a home owner to unsafe temperatures in the stove pipe of a wood- or coal-burning stove by signaling an alarm if the pipe gets too hot, thereby providing a warning against a potential fire hazard that can be caused by creosote build-up.

14 Claims, 1 Drawing Sheet

OVERHEATED STOVE PIPE ALARM

BACKGROUND OF THE INVENTION

1. Field of the Invention

This invention generally relates to an apparatus for warning of an unsafe overheated condition in a stove pipe during operation of a wood- or coal-burning stove and, more particularly, for warning a home owner of a potential fire hazard in the stove pipe in the event of creosote build-up therein.

2. Description of Related Art

The burning of wood and/or coal in a stove causes creosote to form and be deposited on all stove surfaces exposed to the combustion gases and by-products formed during stove operation. The build-up of creosote is of particular importance when it occurs on the inner circumferential surface of an upright stove pipe of such a stove, because creosote can burn when exposed to elevated temperatures on the order of 750° to 800° F., and can feed a fire within the stove pipe.

Prudence dictates regular cleaning and removal of the creosote from within the stove pipe. However, many home owners are often negligent in, or ignorant of the importance of, maintaining a regular stove maintenance program. Since such cleaning is a messy procedure, at best, it is often left to professional stove cleaners, the expense for which often prompting the home owner to delay such cleaning. This negligence and/or ignorance exposes such home owners and their families to the risk of stove pipe fires which, of course, are analogous to chimney fires. Stove pipe fires can generate smoke and, in extreme cases, may spread to adjacent structures. Loss of life and/or bodily injury and/or damage to property are potential consequences of stove pipe fires. The perception on the part of many consumers of the fire risk in such stoves may represent a leading factor as to why wood- or coal-burning stoves are not more popular.

Thermal sensor alarms have been used in many applications, but not in connection with wood- or coal-burning stoves. For example, see U.S. Pat. Nos. 2,982,949; 3,024,657; 4,315,256; 4,255,746; 4,357,602; Re. 30,619; and 4,364,032.

SUMMARY OF THE INVENTION

1. Objects of the Invention

It is a general object of this invention to protect home owners and their families from stove pipe fires.

It is another object of this invention to alert home owners of an unsafe temperature condition in the stove pipe which, if neglected, might lead to a stove pipe fire in the event of creosote build-up.

A further object of this invention is to provide a warning apparatus which is easy to install without requiring any expertise on the part of the home owner and without requiring any tools.

Still another object of this invention is to provide a battery-operated warning apparatus which operates reliably for an extended lifetime without requiring frequent battery replacement.

Yet another object of this invention is to provide a safe, reliable, maintenance-free, compact and easily installed stove pipe fire warning device.

A still further object of this invention is to promote the safe use and enjoyment of coal- and wood-burning stoves.

2. Features of the Invention

In keeping with these objects, and others which will become apparent hereinafter, one feature of this invention resides, briefly stated, in an apparatus for warning of an unsafe overheated condition in a stove pipe during operation of a stove. As previously mentioned, the unsafe overheated condition is an elevated temperature, typically on the order of 750°–800° F. or greater, which, when combined with creosote build-up in the stove pipe, may lead to stove pipe fire.

The apparatus comprises means, such as a battery, or other energy source, for producing electrical energy over a working lifetime, and thermal sensor means energized by the battery. The thermal sensor means, which advantageously is embodied by a bimetallic switch, is operative for detecting the temperature of the stove pipe heated during stove operation by the passage of combustion gases and by-products through the stove pipe. The thermal sensor means generates an electrical signal when the detected temperature exceeds a predetermined magnitude, e.g. 750°–800° F., which is indicative of the aforementioned unsafe overheated condition. The apparatus also includes an alarm means responsive to the electrical signal, and operative for signaling the existence of the unsafe overheated condition. The alarm means may be an illuminated lamp and/or a sound annunciator, e.g. a buzzer.

In accordance with this invention, mounting means are provided for mounting the thermal sensor means in a readily attachable/detachable manner in a direct, intimate, thermal contacting relationship with the stove pipe, for conveying heat from the heated stove pipe directly to the thermal sensor means. Advantageously, the mounting means comprises temperature-resistant magnet means for magnetically attracting the apparatus to, and for magnetically holding the apparatus on, an upright stove pipe to prevent the apparatus from falling under the influence of gravity, despite the presence of heat from the heated stove pipe. The magnet means enables a home owner to install the warning apparatus directly on the upright stove pipe without requiring any particular expertise or any tools.

Still another feature of this invention resides in means for shielding the battery against the heat from the stove pipe. Elevated temperatures encountered during stove operation would tend to shorten the working lifetime of the battery. Hence, to prolong the working lifetime of the battery, the heat-shielding means enables the warning apparatus to be used without frequent battery replacement. Experience has shown that battery replacement need only occur once a year when the battery is shielded by providing a shield plate between the battery and the stove pipe.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
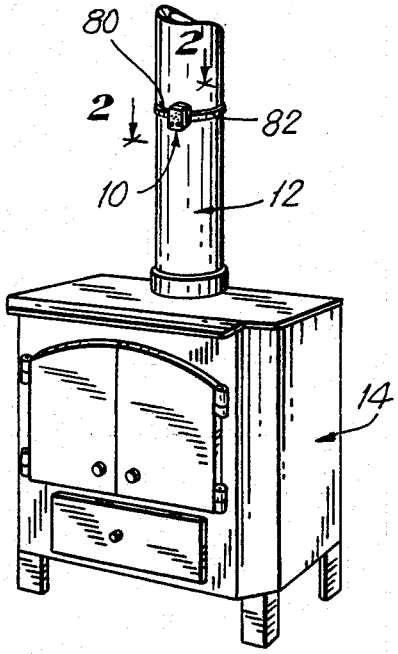
FIG. 1 is a front perspective view of a warning apparatus according to this invention, mounted on an upright stove pipe of a stove.
Figure 2:
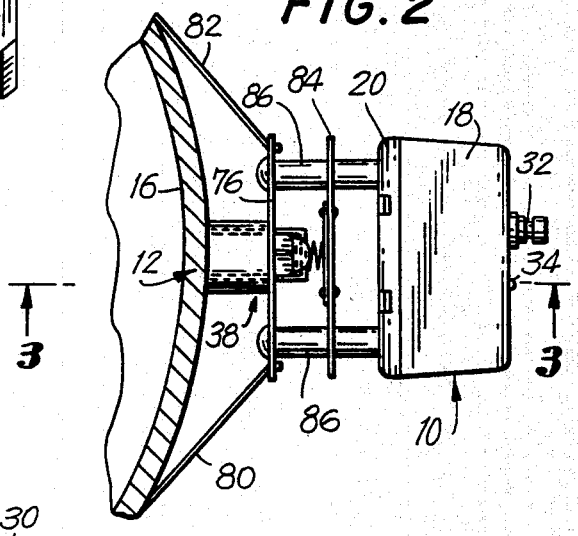
FIG. 2 is an enlarged sectional view taken on line 2—2 of FIG. 1.

Referring now to the drawings, and particularly to FIG. 1 thereof, reference numeral 10 generally identifies a warning apparatus mounted on an upright stove pipe 12 of a coal- or wood-burning stove 14. As best shown in FIG. 2, during stove operation, a layer of creosote eventually forms and builds up on the inner circumferential surface 16 of pipe 12 along which the heated combustion gases and by-products flow prior to discharge into the outside environment. If the heated combustion gases and by-products reach a temperature sufficient to ignite the creosote—a situation which occurs above 750°-800° F., —then the creosote smokes and possibly burns and, if sufficient creosote exists, the creosote will feed a fire in the pipe.

Warning apparatus 10 is operative for alerting the home owner, or anyone else within sight or sound of the apparatus, whether the temperature of the combustion gases and by-products within the pipe equals or exceeds the aforementioned flash point. If so, then an alarm is signaled to warn against a potential fire hazard that can be caused by creosote build-up. Once the alarm has signaled, the prudent home owner should attend to proper stove maintenance and check why the stove is operating at such an elevated temperature, and whether or not there is a build-up of creosote which could be ignited by such elevated temperature.

Figure 3:
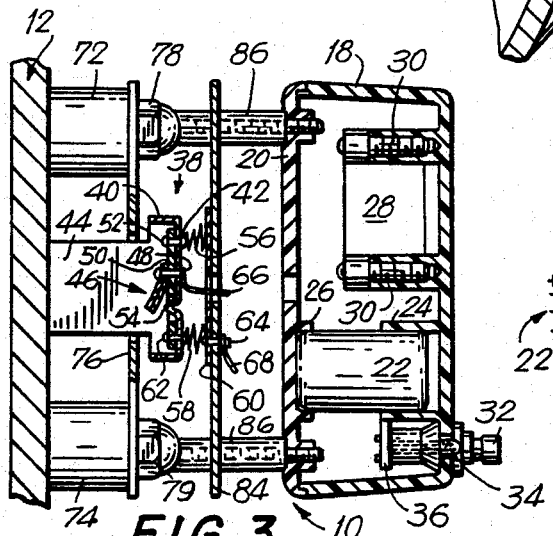
FIG. 3 is a sectional view taken on line 3—3 of FIG. 2.

Turning now to FIG. 3, the warning apparatus 10 includes a synthetic plastic material housing having an upper housing part 18 which is snap-mounted onto a lower housing part 20. When assembled, the housing parts 18, 20 bound an interior space in which a conventional DC battery 22, typically a 9-volt DC battery, is contained. Upper flanges 24 on the upper housing part 18, together with lower flanges 26 on the lower housing part 20, bound a battery compartment for frictionally retaining the battery 22. An electromagnetic buzzer 28 is mounted to the upper housing part 18, preferably with the aid of a pair of threaded fasteners 30. A test switch 32 whose operation is explained in detail below, and a light source such as a light emitting diode 34, are mounted on a common printed circuit board 36 as a subassembly which, in turn, is fixedly mounted on an inner wall of the upper housing part 18.

The warning apparatus 10 further includes a thermal sensor, e.g. a bimetallic switch 38, including a sensor housing 40 having a base plate portion 42 and a heat-sensitive probe 44 extending away from the base plate portion 42. A cantilevered bimetallic blade 46 composed of two different metals has one end mounted on a post 48 which is fixedly mounted on an electrically-insulating plate 50, preferably made of mica. The mica plate is, in turn, connected by a support post 52 on the base plate portion 42. The opposite end of the bimetallic blade 46 is free to move under the influence of heat toward and away from a dimple or electrical contact 54 which is formed in the electrically-conductive sensor housing 40.

A pair of generally conical coil springs 56, 58 are mounted between an insulator plate 60 and the base plate portion 42 for enabling the sensor housing 40 to be movable in a direction generally perpendicular to the plate 60. Spring 56 has its lowermost and smaller coil end secured to support post 52, and its upper larger coil end bearing against plate 60 at one side of the housing 40. At the opposite side of the housing 40, the spring 58 has its lowermost and smaller coil end secured to a support post 62 which, in turn, is anchored in the base plate portion 42. The upper and larger coil end of spring 58 bears against the plate 60, and is secured to an electrically-conductive pin 64 which is secured to the plate 60.

An electrical wire 66 from the anode of the battery 22 is connected to the support post 48 for conveying electrical energy from the battery to the bimetallic blade 46. A ground wire 68 from the cathode of the battery 22 is connected to the pin 64. A grounding path is thereby formed from the battery cathode along the wire 68, pin 64, metallic spring 58, conductive post 62, sensor housing 40, and to the electrical contact 54. When the free end of the bimetallic blade 46 which, at room temperatures, is normally spaced away from the contact 54, is moved under the influence of heat to engage the electrical contact 54, then the bimetallic switch 38 is switched from a normally-open state to a closed state. In the closed state, an electrical signal is generated.

Figure 4:
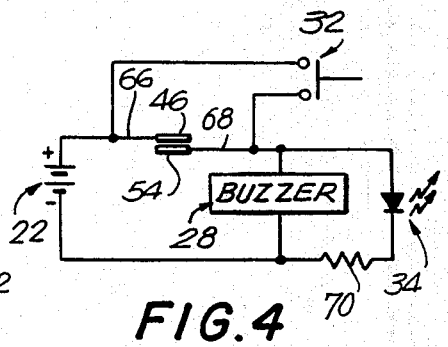
FIG. 4 is an electrical circuit schematic of the components of the warning apparatus of FIG. 1.

The aforementioned probe 44 is mounted, as explained below, in a direct, intimate, thermal contacting relationship with the stove pipe 12. Heat is conveyed along the probe to the housing 40. The circumambient region surrounding the bimetallic blade 46 is thereby heated, thus causing the blade to flex toward the electrical contact 54. When engagement is made between the blade 46 and the contact 54, this corresponds to the detection of an elevated temperature on the order of 575° F. within the stove pipe. The electrical signal generated by the closing of the bimetallic switch is conveyed, as shown in FIG. 4, to either the buzzer 28, thereby generating an audio alarm, and/or to the light emitting diode 34, thereby illuminating the same and generating a visual alarm. A resistor 70 is mounted in series with the light emitting diode to control the current flowing therethrough.

The mounting of the thermal sensor switch in thermal contact with the stove pipe is advantageously effected by temperature-resistant magnet means, e.g. a pair of high temperature magnets 72, 74 mounted on a mounting plate 76 with the aid of threaded fasteners 78, 79 on either side of the probe 44. The magnets 72, 74 magnetically attract the apparatus 10 to, and magnetically hold the apparatus 10 on, the upright stove pipe 12 to prevent the apparatus from falling under the influence of gravity, despite the presence of heat from the heated stove pipe. As is well known, the magnetic attraction properties of a conventional magnet degrade when the magnet is exposed to elevated temperatures. However, in this application, special high temperature magnets are selected so that their magnetic properties resist temperatures on the order of 575° F. or higher. Although some compromise in the magnetic properties is expected with elevated temperatures, the high temperature magnets 72, 74 of this invention still retain their magnetic properties to the extent of maintaining the apparatus, which, in a preferred embodiment, weighs on the order of 9 oz., on the stove pipe and prevents said apparatus from falling.

Although not strictly necessary to maintain the apparatus on the heated stove pipe, a pair of optional mounting straps 80, 82 (see FIG. 2) can be tied around the stove pipe and secured to the mounting plate 76 through apertures formed therein. In a preferred embodiment, the straps may constitute a pair of metal wires whose opposite ends are twisted about each other on the far side of the pipe opposite that of the apparatus.

The magnets 72, 74, with or without the assistance of the straps 80, 82, hold the apparatus 10 on the upright stove pipe. Prior to mounting, the probe 44 extends past the plane in which the outer end faces of the magnets lie. After installation, the probe 44 is pushed back to lie in said plane, thereby compressing the springs 56, 58 in the process. The springs 56, 58 constantly exert a force on the probe to urge the same into tight engagement with the outer wall of the stove pipe, thereby ensuring an intimate contact therewith.

In order to secure a long working lifetime for the battery 22, which constitutes the sole source of power for the apparatus, this invention proposes shielding the battery against the heat radiated from the stove pipe 12. For this purpose, a heat sink plate 84 is located between the battery 22 and the stove pipe 12. Advantageously, the heat sink plate 84 is located on, and connected to, the insulator plate 60.

In addition, a plurality of standoffs or elongated spacer elements 86, one located at each corner region of the mounting plate 76, are operative for positioning the housing and the battery 22 therein at a predetermined distance away from the pipe 12. Each spacer element 86 has opposite threaded ends which respectively engage threaded openings in the lower housing part 20 and the mounting plate 76.

As best shown in FIG. 4, the test switch 32 is electrically connected in parallel across the bimetallic switch. When the test switch is manually depressed, the bimetallic switch is shorted out, thereby generating an electrical signal which, in turn, causes the buzzer 28 and/or the light emitting diode 34 to operate. This simulates the unsafe overheated condition in the stove pipe, and can be used by the home owner to check whether the circuit is indeed operational. Should no alarm be signaled when the test switch 32 is depressed, the failure would typically lie in the battery having outlived its useful life, thereby advising the home owner to replace the dead battery with a fresh one The operation of the warning apparatus is believed to be clear from the above description. By way of brief summary, the apparatus may be easily installed by the home owner on the stove pipe by merely placing the apparatus thereon. The magnets hold the apparatus in place and do not require any particular expertise on the part of the home owner or any tools to effect the installation. The battery 22 constitutes the sole power source and, hence, no external connection or wires to any external power source are necessary.

Once installed, the springs 56, 58 ensure that the probe 44 is maintained in engagement with the stove pipe. The operation of the bimetallic switch is automatic and, once a temperature equaling or exceeding 575° F. is detected, the bimetallic switch 38 closes, thereby generating an electrical signal which causes either the buzzer 28 to sound and/or the light emitting diode 34 to illuminate. Battery lifetime can easily last for a year or so because of the presence of the heat sink plate 84, the insulator plate 60 and the positioning of the battery within a housing and well away from the stove pipe, protects the battery from heat damage. Should battery replacement be required, it is merely necessary for the home owner to remove the apparatus from the stove pipe by merely pulling the apparatus therefrom and countering the magnetic attraction forces generated by the magnets 72, 74. The housing part 18 can be separated from the housing part 20, thereby exposing the interior and permitting replacement of the battery.

The apparatus itself can be mounted in plain view on the front of the stove pipe or, because of its compact nature, can be mounted out of sight behind the stove pipe.

It will be understood that each of the elements described above, or two or more together, also may find a useful application in other types of constructions differing from the types described above.

While the invention has been illustrated and described as embodied in an overheated stove pipe alarm, it is not intended to be limited to the details shown, since various modifications and structural changes may be made without departing in any way from the spirit of the present invention and such will be fully appreciated by those skilled in the art.

We claim:

1. An apparatus for warning of an unsafe overheated condition in a stove pipe during burning of a fuel in a stove, comprising:

(a) a housing having walls bounding an interior;

(b) energy means within the interior of the housing, and operative for supplying electrical energy over a working lifetime;

(c) means for attachably mounting the housing and the energy means therein on, and at a spacing from, the stove pipe;

(d) thermal sensor means electrically connected to the energy means and including a heat-sensitive probe and a heat detector operative for detecting the temperature of the stove pipe heated during fuel burning;

(e) means for resiliently mounting and for constantly urging the probe away from the housing and into a direct, intimate, thermal contacting relationship with the stove pipe to directly convey heat from the heated stove pipe along the probe to the heat detector;

(f) alarm means responsive to the thermal sensor means, and operative for signaling the existence of the unsafe overheated condition when the detected temperature exceeds a predetermined magnitude; and (g) means for shielding the energy means against the heat from the heated stove pipe when the housing and the energy means therein are attached on the heated stove pipe, thereby prolonging the working lifetime of the energy means.

2. The apparatus according to claim 1, wherein the apparatus includes temperature-resistant magnet means for magnetically attracting the apparatus to, and for magnetically holding the apparatus on, an upright stove pipe to prevent the apparatus from falling under the influence of gravity despite the presence of heat from the heated stove pipe.

3. The apparatus according to claim 2, wherein the magnet means includes at least one high temperature magnet having magnetic properties resistant to temperatures on the order of 750°–800° F.

4. The apparatus according to claim 2, wherein the apparatus further includes means for strapping the apparatus around the upright stove pipe to assist the magnet means in holding the apparatus on the upright stove pipe.

5. The apparatus according to claim 1, wherein the energy means is a battery.

6. The apparatus according to claim 5, wherein the battery is mounted in the housing.

7. The apparatus according to claim 6, wherein the probe mounting means includes a mounting plate on which magnet means are mounted; and wherein at least one elongated spacer is located between the mounting plate and the housing, for positioning the battery and the housing at said predetermined distance.

8. The apparatus according to claim 1, wherein the shielding means includes a heat sink plate in said spacing between the housing and the heated stove pipe.

9. The apparatus according to claim 1, wherein the alarm means includes an auditory indicator for emitting a sound alarm when the unsafe overheated condition is detected.

10. The apparatus according to claim 1, wherein the alarm means includes a visual indicator for emitting a visible alarm when the unsafe overheated condition is detected.

11. The apparatus according to claim 1, wherein the heat detector includes a sensor switch having a cantilevered bimetallic blade movable between open and closed states as a function of the temperature of the heated stove pipe.

12. The apparatus according to claim 11; and further comprising means for testing the operation of the alarm means by shorting the sensor switch to simulate the existance of the unsafe overheated condition.

13. An apparatus for warning of an unsafe overheated condition in an upright stove pipe during burning of a fuel in a stove, comprising:

(a) a housing having walls bounding an interior;

(b) a battery within the interior of the housing, and operative for supplying electrical energy over a working lifetime;

(c) means for attachably mounting the housing and the battery therein on, and at a spacing from, the upright stove pipe;

(d) thermal sensor means electrically connected to the battery and including a heat-sensitive probe and a heat detector operative for detecting the temperature of the upright stove pipe heated during fuel burning;

(e) means for resiliently mounting and for constantly urging the probe away from the housing and into a direct, intimate, thermal contacting relationship with the upright stove pipe to directly convey heat from the heated stove pipe along the probe to the heat detector;

(f) alarm means responsive to the thermal sensor means, and operative for signaling the existence of the unsafe overheated condition when the detected temperature exceeds a predetermined magnitude; and (g) a heat shield plate located in said spacing for shielding the battery against the heat from the heated stove pipe when the housing and the battery therein are attached on the heated stove pipe, thereby prolonging the working lifetime of the battery.

14. The apparatus according to claim 3, wherein the magnet has a generally planar outer face, and wherein the probe has an outer end, and wherein the probe mounting means includes at least one spring operative for constantly urging the outer end of the probe past the plane of the outer face of the magnet, said spring being compressible upon attachment of the apparatus to the stove pipe.

* * * * *